US008547801B2

(12) United States Patent
Zorn et al.

(10) Patent No.: US 8,547,801 B2
(45) Date of Patent: Oct. 1, 2013

(54) STOP LIGHT GO LIGHT TIMER

(76) Inventors: Courtney Anne Zorn, Murphy, TX (US); Whitney Kay Burkhardt, Allen, TX (US)

( * ) Notice: Subject to any disclaimer, the term of this patent is extended or adjusted under 35 U.S.C. 154(b) by 153 days.

(21) Appl. No.: 13/135,190

(22) Filed: Jun. 28, 2011

(65) Prior Publication Data

US 2012/0026844 A1 Feb. 2, 2012

Related U.S. Application Data

(60) Provisional application No. 61/400,635, filed on Jul. 29, 2010.

(51) Int. Cl.
*G04C 19/00* (2006.01)

(52) U.S. Cl.
USPC ..... 368/109; 368/83; 368/241

(58) Field of Classification Search
USPC ..... 368/82–84, 239, 241, 107–109
See application file for complete search history.

(56) References Cited

U.S. PATENT DOCUMENTS

| | | | | |
|---|---|---|---|---|
| 2,932,779 | A * | 4/1960 | Tancig | 318/466 |
| 3,320,585 | A * | 5/1967 | Hines | 340/929 |
| 4,062,180 | A * | 12/1977 | Meshi et al. | 368/96 |
| 4,151,831 | A * | 5/1979 | Lester | 600/549 |
| 4,223,801 | A * | 9/1980 | Carlson | 221/3 |
| 4,275,384 | A * | 6/1981 | Hicks et al. | 340/309.4 |
| 4,681,463 | A * | 7/1987 | Bendit | 368/96 |
| 4,973,052 | A * | 11/1990 | Conti | 273/444 |
| 5,044,961 | A | 9/1991 | Bruskewitz | |
| 5,119,346 | A | 6/1992 | Henderson et al. | |
| 5,325,340 | A * | 6/1994 | Ramsey | 368/3 |
| 5,570,325 | A | 10/1996 | Arpadi | |
| 5,684,758 | A | 11/1997 | Gray et al. | |
| 6,074,076 | A | 6/2000 | Parrish-Bhagwat | |
| 6,326,883 | B1 * | 12/2001 | Whitehead et al. | 340/309.8 |
| 6,416,216 | B1 | 7/2002 | Haughey | |
| D478,010 | S * | 8/2003 | Chen | D10/2 |
| D524,674 | S * | 7/2006 | Masters | D10/122 |
| 7,414,923 | B2 | 8/2008 | Kadokura | |
| 7,729,206 | B2 * | 6/2010 | Gordon et al. | 368/109 |
| 8,077,552 | B1 * | 12/2011 | Pope et al. | 368/109 |
| 8,295,130 | B2 * | 10/2012 | Claessens | 368/73 |
| 2005/0041534 | A1 | 2/2005 | McCarthy | |
| 2008/0138782 | A1 | 6/2008 | Klein | |
| 2008/0192580 | A1 | 8/2008 | Larian | |
| 2009/0219787 | A1 | 9/2009 | Ortega | |
| 2010/0274527 | A1 * | 10/2010 | Ruff et al. | 702/178 |
| 2012/0157246 | A1 * | 6/2012 | Glover et al. | 473/570 |

FOREIGN PATENT DOCUMENTS

WO WO-03/096126 5/2003

* cited by examiner

*Primary Examiner* — Sean Kayes

(57) ABSTRACT

A timer device to induce and encourage a young child to manage time when engaged in daily activities, the timer device comprising visually comprehensible changes in time through the use of red and green lights for the start and end of activity period, respectively. The timer device can further include an audible alarm to signal the end of the activity. Further operational switches and buttons include a power button or switch, start/pause button to start time or pause time, engage buttons, hours buttons (+, −) and minutes buttons (+, −) to adjust time on a liquid crystal display (LCD). The timer device can be powered by AC power or battery power.

11 Claims, 8 Drawing Sheets

STOP LIGHT GO LIGHT TIMER

CROSS REFERENCE TO RELATED APPLICATION

This application claims the benefit of U.S. Provisional Application No. 61/400,635 filed on Jul. 29, 2010, entitled "STOP LIGHT GO LIGHT TIMER."

FIELD OF THE INVENTION

The present invention relates generally to timers used for timing every day activities and tasks. More particularly, the invention relates to timers for children to encourage and cultivate in them an appreciation of a sense of time when engaging in various everyday activities.

BACKGROUND OF THE INVENTION

Managing and keeping track of time when engaging in various activities is a cumbersome task at any age. Setting alarms to wake up from a slumber or as a reminder for the commencement or completion of a task is a practice followed by many adults to efficiently manage the use of time in their everyday activities and when performing particular tasks.

Children in particular, have difficulty understanding the concept of time and adhering to time constraints placed on them for the commencement and completion of everyday activities, from mealtime, to bedtime, and all other activities in between. Although establishing a day to day routine for activities is necessary to help the child develop good habits, sticking to time schedules in the commencement and completion of tasks and activities is equally crucial to developing a sense of self discipline and confidence in the child.

Expecting a young child or adolescent to complete activities and tasks in a timely manner has been the bane of parents and caregivers from time immemorial. Sometimes much to the consternation of the parent or caregiver, the reminders on sticking to a predetermined schedule and time does not produce desirable results because the child or adolescent looses track of time while they are engrossed in activities that are of particular interest to them. Often times these situations end up in a tug of war between the parent or caregiver and the child with the parent or caregiver losing their patience with the child and resulting in incomplete assigned chores and stubbornness from an adolescent or temper tantrums in the case of a young child. This is neither good for the child nor the parent or caregiver.

Verbal reminders about the passage of time to commence or complete an activity or task may work well with children who are old enough to read the clock or time piece. However, toddlers and pre-school age children who are not able to tell time from a clock need other means of persuasion to stick to time schedules when it comes to meal time, play time, nap time, etc.

What is needed is a system and method to inculcate an appreciation for the concept of time in young children who have not developed the skills to manage time on their own when engaged in their daily activities without constant reminders from their parents or caregivers. Such a system and method would assist children as young as two years to appreciate and understand the concept of time and develop in them a sense of self reliance in managing time when engaged in their day to day routines and activities.

Clocks and timing devices with the young child in mind have been developed and are well known in the art. For example, clocks and time pieces with alarms for children have been described in U.S. Pat. No. 5,119,346; U.S. Pat. App. Pub. No. 2008/0192580; and U.S. Pat. App. Pub. No. 2005/0041534. Other clocks and time devices are specifically meant to teach a young child to tell time. These include, the kiddy clock described in Jap. Pat. Pub. No. 2006508331 and the teaching clock as described in U.S. Pat. App. Pub. No. 2008/0138782.

In recent times, timing devices have been developed specifically focused on particular children's tasks and activities. An example of such a timing device is the tooth brush timing device of U.S. Pat. No. 6,074,076 intended to alert a small child to brush and to stop brushing their teeth at particular times. Other timers focused on tooth brushing timing for a child include, the timer for brushing teeth described in U.S. Pat. Appl. Pub. No. 2009/0219787, tooth brushing timer as in U.S. Pat. No. 5,570,325, and teeth cleaning time piece as in EPO. No. 831382.

Timers with clock faces designed to remind a child or adolescent of the time for a particular activity as illustrated in the graphical organizational task timer in U.S. Pat. No. 7,414,923, the child activity timer as in U.S. Pat. No. 5,044,961; and the event clock as in U.S. Pat. No. 6,416,216; U.K. Pat. App. No. 2,427,285; the child disciplinary device as in U.S. Pat. No. 5,684,758 are also well known in the art.

The above mentioned prior art may work with young children and adolescents who are capable of reading time from a clock face. The devices described in the prior art will not be effective in helping toddlers and pre-school age children who have not developed the skills to read time from a clock face and who are easily distracted by their environment to keep track of the time constraints placed on them for particular activities such as play time, nap time etc.

SUMMARY OF THE INVENTION

The timer of the present invention overcomes the deficiencies in the prior art by providing a simple, easy to comprehend, visual timing device for young children capable of assisting them in remembering when to start and complete an activity and relieves the parent or caregiver from the burden and frustration of having to constantly remind the young child that time is up for play time, or it is time for nap time, etc.

The present invention relates to an easily understandable and visually perceptible timer device to assist children to manage their time efficiently in their daily activities and develop in them an appreciation for the concept of time and self reliance in managing time in their young lives.

In an exemplary embodiment of the present invention, the timer apparatus of the invention is comprised of a timer face with red and green, light emitting diode (LED) lights akin to traditional traffic lights. In this embodiment, the red light signals the start of an activity to the child and the green light indicates the time for completion of that activity. A yellow lens is located axially between the red and green LEDs solely for aesthetic purposes.

In this exemplary embodiment of the present invention, the young child does not have to read time on the face of a clock to commence and complete an activity. Rather, a toddler or young child who is conversant with the manner in which traffic lights operate can easily be taught to understand that the red light means it is time to start an activity such as playtime or nap time and the green light indicates that time is up for that activity and time to move on to another one. In this manner, the child has a visual concept of the passage of time without having to count the hours and minutes on the face of a clock.

In the exemplary embodiment of the present invention, the red and green lights for the commencement and completion of an activity are operated through a console face set atop the timer apparatus. This timer console is comprised of a power switch, hour buttons (+/−), minute buttons (+/−), a liquid crystal display (LCD) digital time panel with the hours and minutes displayed on the panel, a start/pause button to control the time, and an audible alarm alert button for use with the red and green lights when necessary.

The exemplary embodiment of the present invention also has a feature in the form of two engage buttons, one provided on the right hand side and the other on the left hand side of the timer apparatus for ease of use for both right handed and left handed operators of the timer device. In this embodiment of the invention, the engage buttons are used to control the other buttons on the timer device and act as safety devices to prevent a child from tampering with preset times for their activities. The timing buttons on the console face do not operate unless one of the engage buttons are depressed and held in place except when cancelling a green light or audible alarm. The green light may be cancelled using any key including the engage key.

In a preferred embodiment of the present invention, the power button is depressed to turn on the timer apparatus. The timer is set to display the hours and minutes on the LCD digital time panel by depressing the engage button and the hour and/or minute button at the same time. The red light in the front face of the timer apparatus comes on after the hours and minutes are set on the LCD digital time panel and the start/pause button is depressed. The digital timer starts to count down the hours and minutes for the activity when one of the engage buttons and the start button is depressed. The red light remains illuminated until the timer counts down to zero. Once the timer arrives at zero, the green light is illuminated. This alerts the child that the time for the activity has come to an end. In the preferred embodiment, the start/pause button can also be used to pause and start the timer if depressed within, e.g., thirty (30) minutes of the timer expiring.

In yet another preferred embodiment of the present invention, an audible alarm may be generated alongside the illumination of the green light to signal to the child to end an activity in the event the child is distracted during an activity and is not paying attention to the light changes on the timer apparatus.

These and other embodiments, features, and advantages of the present invention will become obvious to one skilled in the art through the description of the drawings, detailed description of the invention and the appended claims.

DETAILED DESCRIPTION OF THE INVENTION

Figure 1:
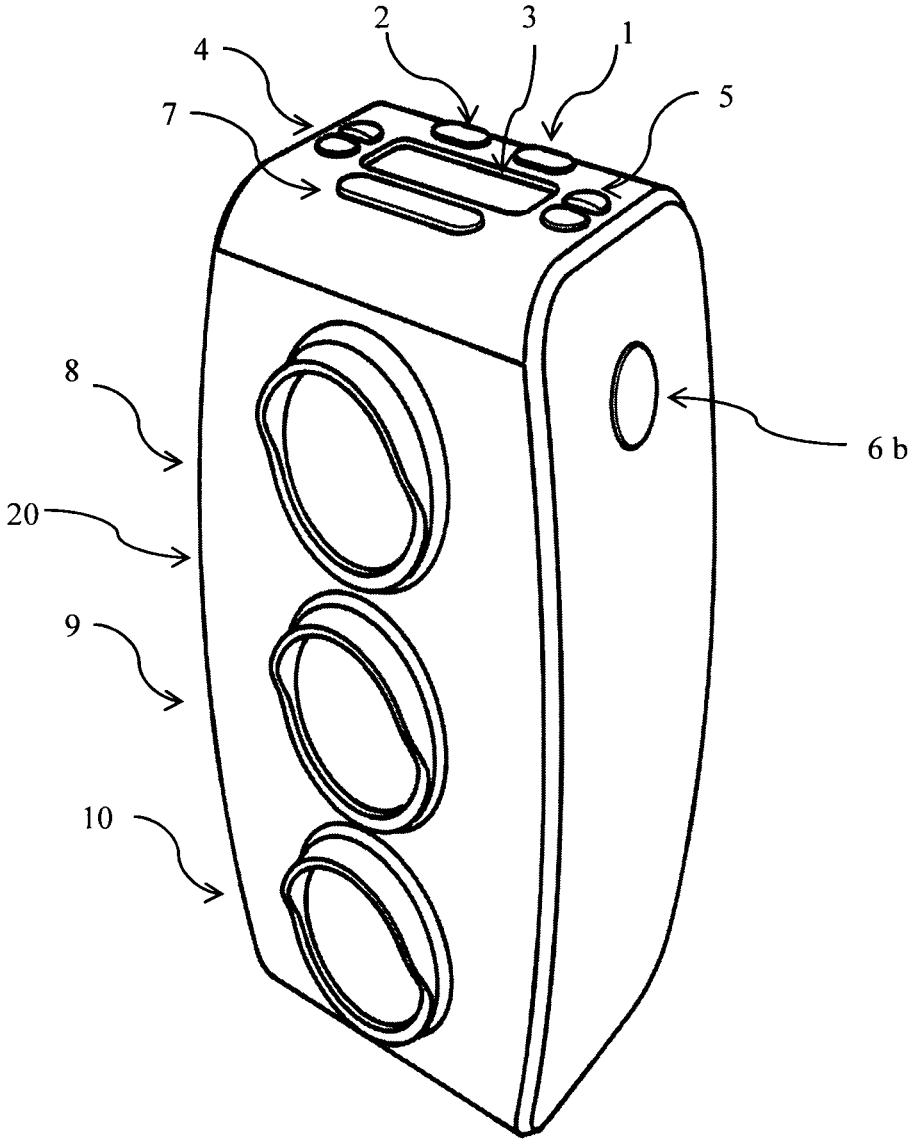
FIG. 1 shows a perspective view of the timer apparatus of the present invention.

FIG. 1, shows a perspective view of the apparatus of the timer device 20. The timer device 20 is turned on by depressing the power button, 1. The LCD digital time display panel 3 lights up and reads 0:00. The time for an activity is set with the hour buttons (+/−) 4 and/or the minute buttons (+/−) 5. Operating the hour 4 button or the minute 5 button requires depressing the buttons simultaneously with one of the engage buttons, 6*a*, or 6*b*. Hours and minutes may be entered on the LCD digital time display panel 3 by tapping the respective buttons up or down or pressing and holding the buttons for rapid scrolling of time values up or down. Once the time values are entered in the LCD digital time display panel 3 the timer countdown begins when the start/pause button 7 is pressed while still depressing one of the engage buttons, 6*a*, or 6*b*. Once the start/pause button 7 is pressed to begin the time countdown, the colon on the LCD digital time display panel 3 flashes to indicate that the time is counting down to 0:00. Once the timer countdown starts, the red light 8 on the front face of the timer apparatus 20 illuminates to signal to the child the start of an activity period. When the time set for an activity has expired, the LCD digital time display panel 3 will show 0:00 and simultaneously, the green light 10 at the bottom front face of the timer apparatus 20 will light up to signal to the child that time is up for that activity. The functions as described are implemented using electronic circuitry, the implementation of which is selected from a group consisting of transistors and timing circuits, an integrated circuit, a system on a chip (SoC), application specific integrated circuit (ASIC) and processor and memory, or combinations thereof, as further described herein. As used herein, lights may be comprised of light emitting diodes (LEDs), incandescent lights, light bulbs or similar devices that, when energized, emit electromagnetic radiation in the human visible light spectrum. Furthermore, the lights themselves may be white lights located behind colored lenses so that the emitted light from the front of the apparatus is filtered by the lens to only emit the desired light color.

In an exemplary embodiment of the present invention, the parent or caregiver may pause a running time on the LCD digital time display panel 3 by pressing the start/pause button 7. Pausing the timer causes the timing to suspend, but the red light 8 at the front face of the timer apparatus 20 remains lit for 30 minutes while the timer is paused. The time countdown may be resumed any time within the 30 minute window period by pressing the start/pause button 7. If 30 minutes elapses in the paused state, then the timer apparatus 20 powers down completely with all lights turning off as a power saving measure.

In yet another embodiment of the invention, the parent or caregiver may adjust the time on the LCD digital display panel 3 in the middle of a timing session by depressing one of the engage buttons, 6*a*, or 6*b* and changing the time set for the activity by pressing the hour 4 or minute 5 buttons up or down to set the desired time. As noted herein, the buttons for the hours and minutes can comprise two buttons for the hour on the left side, one button (e.g, the top one) being a plus (+) sign to increase the hours. The other button (e.g., the bottom one) is a minus (−) sign and to decrease the hours. A similar mechanism is utilized for the minutes side. The timer automatically enters a paused state while an engage button 6*a*, or 6*b* is depressed and timing is resumed when the engage button 6*a*, or 6*b* is released.

In the exemplary embodiment of the present invention, the operations of the green light 10 depends on the power source 15. In one embodiment of the invention, the timer apparatus 20 of the present invention may use an AC outlet as the power source 15. With AC power, once the green light 10 turns on at the end of the activity time period, the light stays illuminated until the user turns it off by pressing any button on the timer (including the engage buttons). Depression of any single key will turn off the green light 10. If the power key 1 is used to turn off the green light 10, the power key 1 and an engage button 6*a* or 6*b* will have to be depressed again to shut off power to the timer apparatus 20.

In yet another exemplary embodiment of the present invention, the timer apparatus 20 can be powered by battery as the power source 15. In this embodiment of the invention, when the green light 10 is illuminated at the end of the activity period, it stays illuminated for five minutes. At the end of that five minute period, the green light 10 automatically turns off. When battery power is being used as power source 15, if after ten minutes, the device is not being used, that is, none of the operational buttons have been depressed, then the apparatus will automatically power down to save battery charge. More specifically, if the green LED is off and no buttons have been depressed for ten minutes, the apparatus will power down.

An embodiment of the present invention uses an audible alarm alert which can be turned on and off with the alarm bell key 2. The audible alarm which produces a beep-beep, beep-beep sound or other desired sound effect, can be turned on as an additional measure to signal to the child the end period of the activity in the event the child is not paying attention to the lights on the invention while distracted and immersed in their activities. A bell icon appears on the LCD digital time display panel 3 when the audible alarm bell key 2 is activated. The duration of the audible alarm alert is one minute or until cancelled by pressing any key on the apparatus, including the audible alarm bell key 2, the power button or the engage buttons, 6*a*, or 6*b*.

The embodiments of the invention have a built in low battery and/or power supply indicator. A low battery icon appears in the LCD digital time display panel 3 when the battery power is low.

Figure 2:
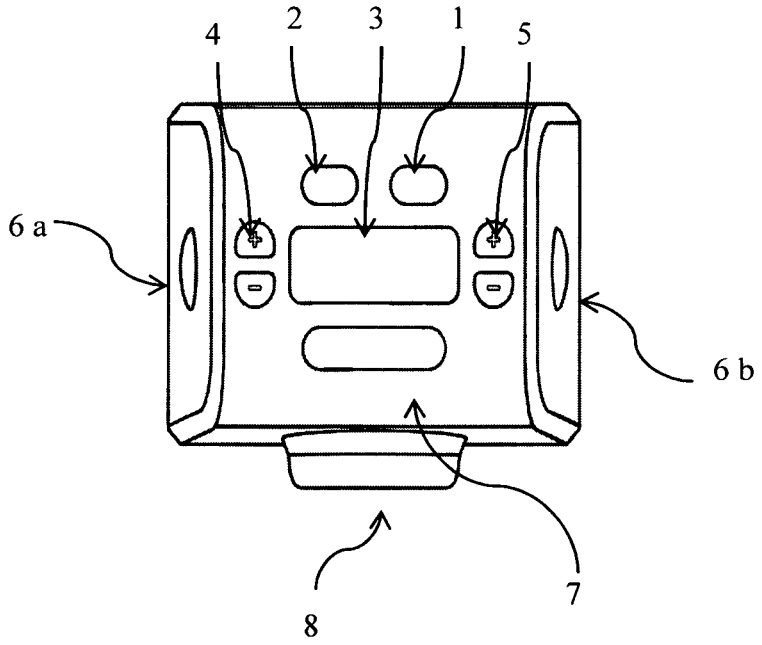
FIG. 2 is a top planar view of the timer console.

Referring now to FIG. 2, the top planar view of the timer apparatus 20 console is shown. The timer is set by depressing one of the engage buttons, 6*a*, or 6*b* simultaneously with pressing on the hour and/or the minute plus/minus buttons 4, 5 to set the time. While simultaneously holding the engage button 6*a*, or 6*b* in a depressed state, the start/pause button 7 is pressed to start the time countdown or paused to change time. The LCD digital time display panel 3 will light up and show the hours and/or minutes entered via the plus/minus buttons 4, 5 and the bell icon when the audible alarm is set or the low battery icon when battery power is low.

Figure 3:
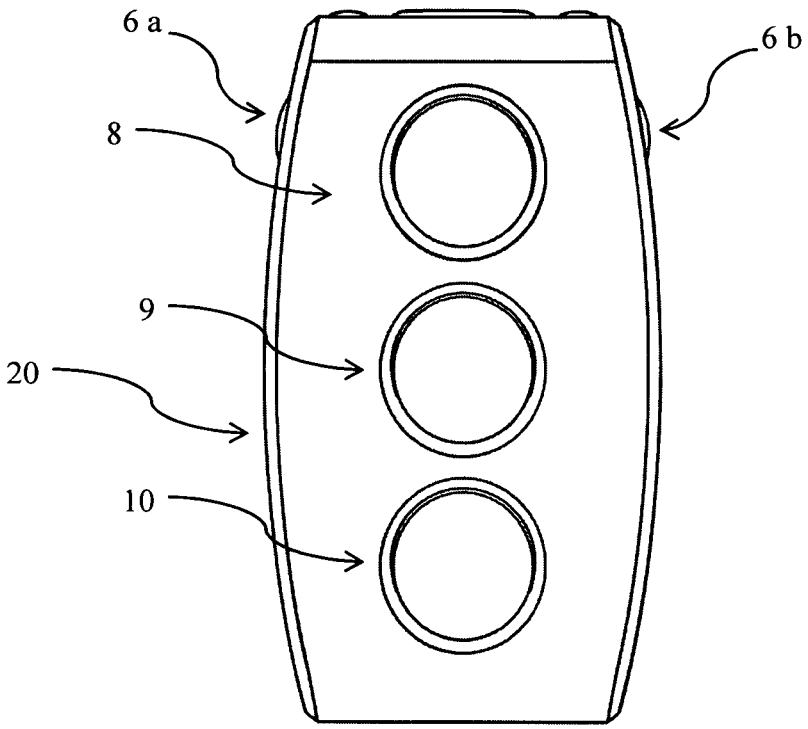
FIG. 3 is a front view of the timer of the present invention.

FIG. 3 shows the front view of the timer apparatus 20 of the present invention with the left 6*a*, and the right 6*b* engage buttons and the red start light 8, yellow lens 9 and the green stop light 10.

Figure 4:
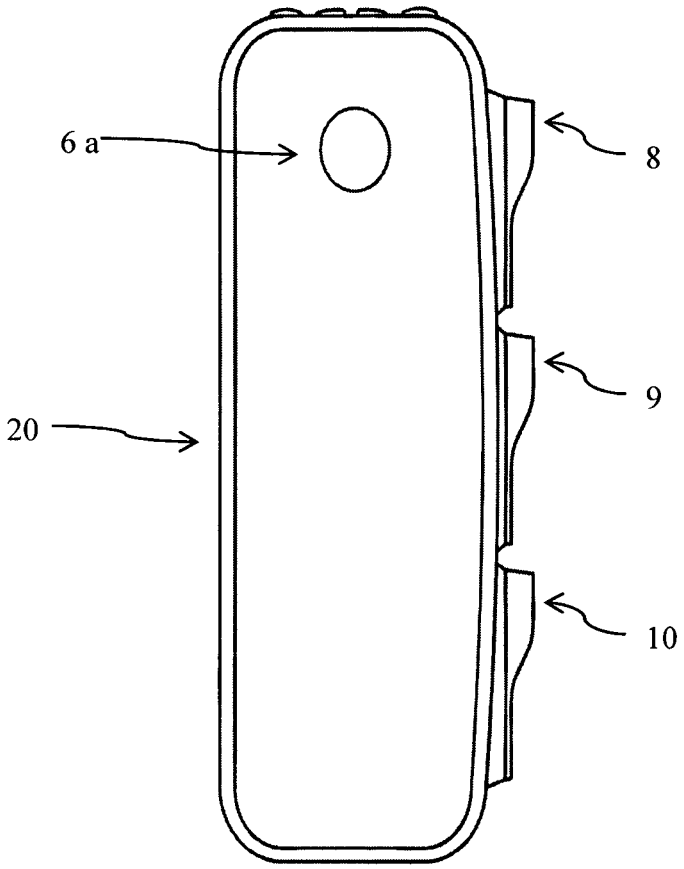
FIG. 4 is the right side view of the timer of the present invention.

FIG. 4 shows the left side view of the timer apparatus 20 of the present invention with the left side engage button, 6*a*, and side views of the red start light 8, yellow lens 9, and the green stop light 10.

Figure 5:
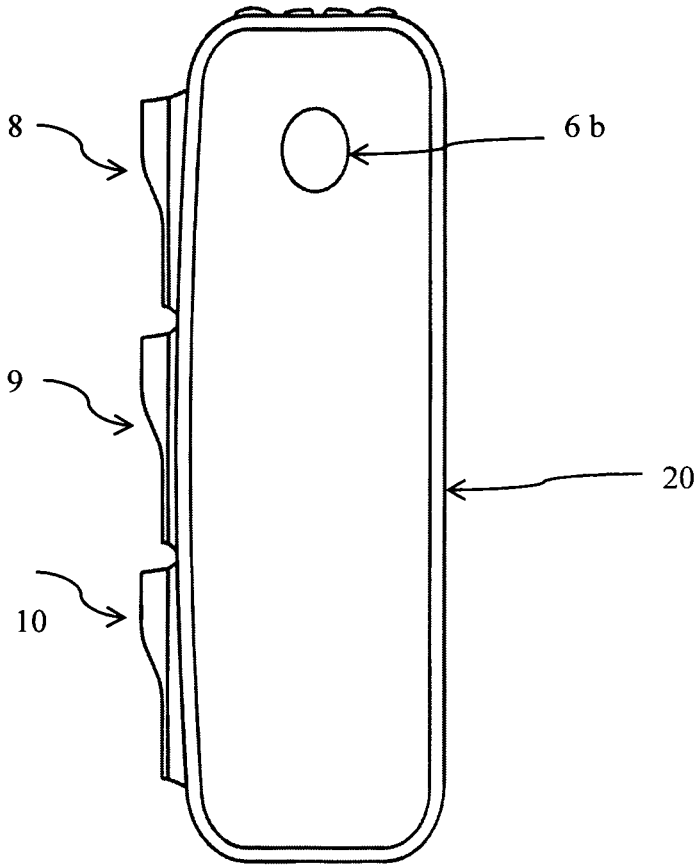
FIG. 5 is the left side view of the timer of the present invention.

FIG. 5 shows the right side view of the timer apparatus 20 of the present invention with the right side engage button, 6*b*, and side views of the red start light 8, yellow lens 9, and the green stop light 10.

Figure 6:
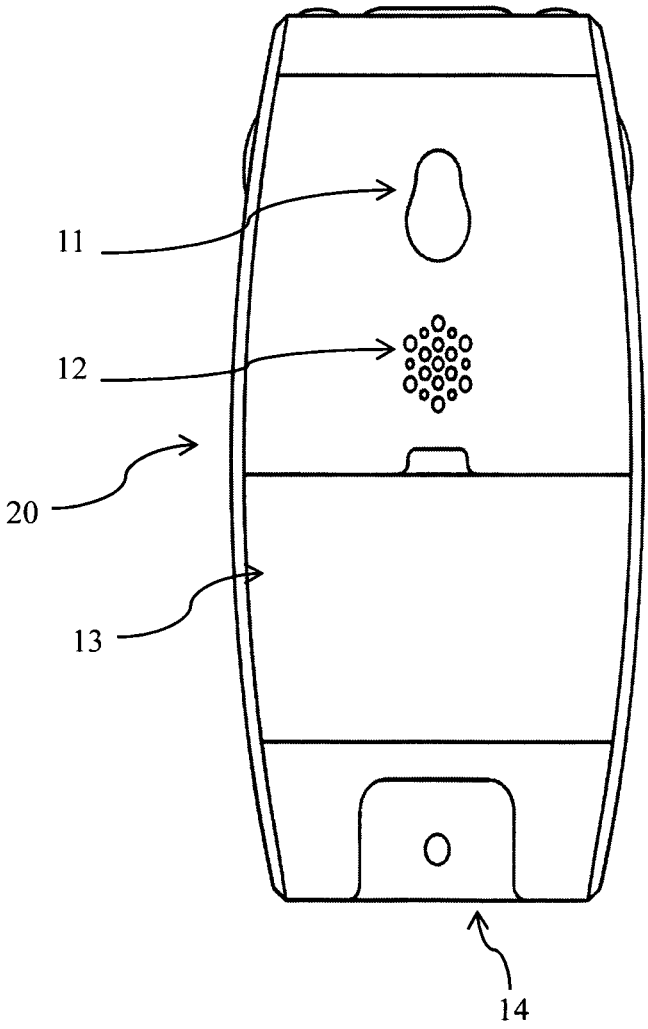
FIG. 6 is the back view of the timer of the present invention.

FIG. 6 shows the back side of the timer apparatus 20 with an orifice or key aperture 11 for hanging the timer from a hook or other such device, speaker 12 for the alarm alert sound, battery compartment 13, and AC adapter 14 for plugging into a wall electrical outlet.

Figure 7:
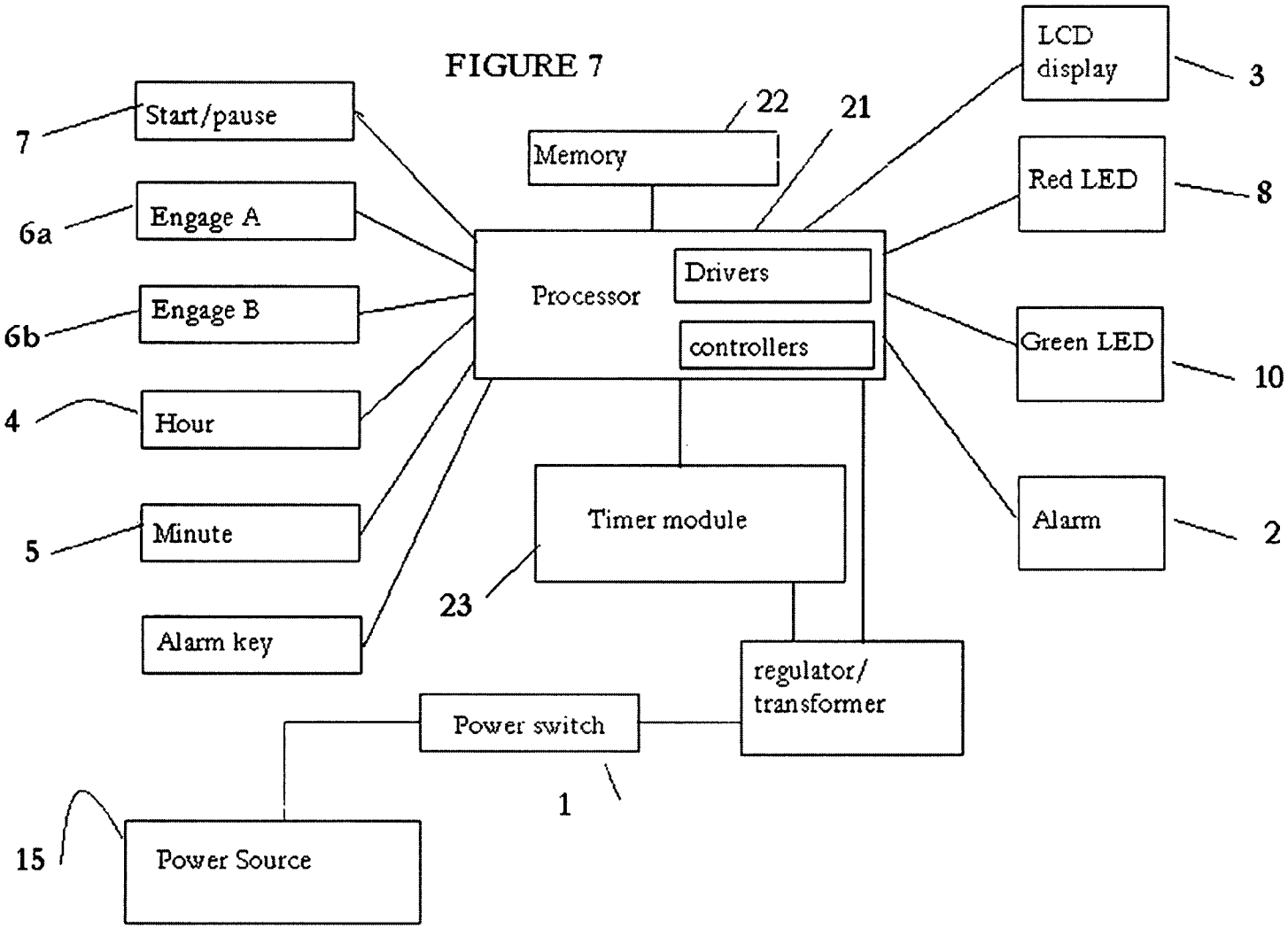
FIG. 7 is a block diagram of the timer apparatus of the present invention.

FIG. 7 is a block diagram of the timer apparatus of the present invention. The functions as described are implemented using electronic circuitry, the implementation of which is selected from a group consisting of transistors and timing circuits, an integrated circuit, a system on a chip (SoC), application specific integrated circuit (ASIC) and microprocessor and memory, or combinations thereof, as further described herein. As seen therein, a processor 21 receives instructions stored on a computer readable memory 22, which may be a ROM, VRAM, NVRAM, Flash or similar memory. A timer module 23 provides timing signals to the processor 21. The timing signals can be derived from a crystal oscillator, timing IC, such as a 555 IC, or resistor-capacitor, or inductor-capacitor or similar circuit. The processor has included therein at least one controller sub-circuit and driver sub-circuit to control the input commands, timer commands and drive output to the LEDs and audible alarm. The sub-circuits themselves may be sub-processors executing instructions loaded from computer readable memory locations.

Figure 8A:
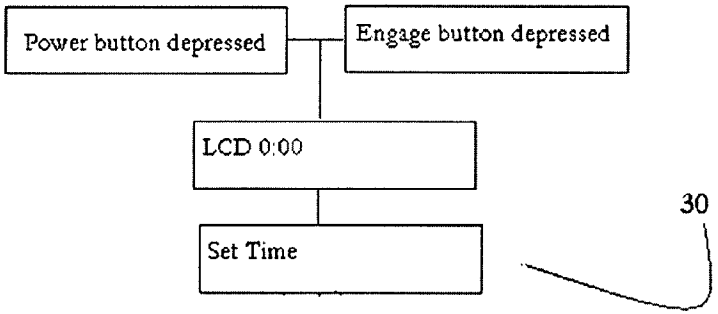
FIG. 8*a* is a flow chart of the set-up of the timer apparatus of the present invention and FIG. 8*b* is a flow chart of the operation of the timer apparatus of the present invention.
Figure 8B:
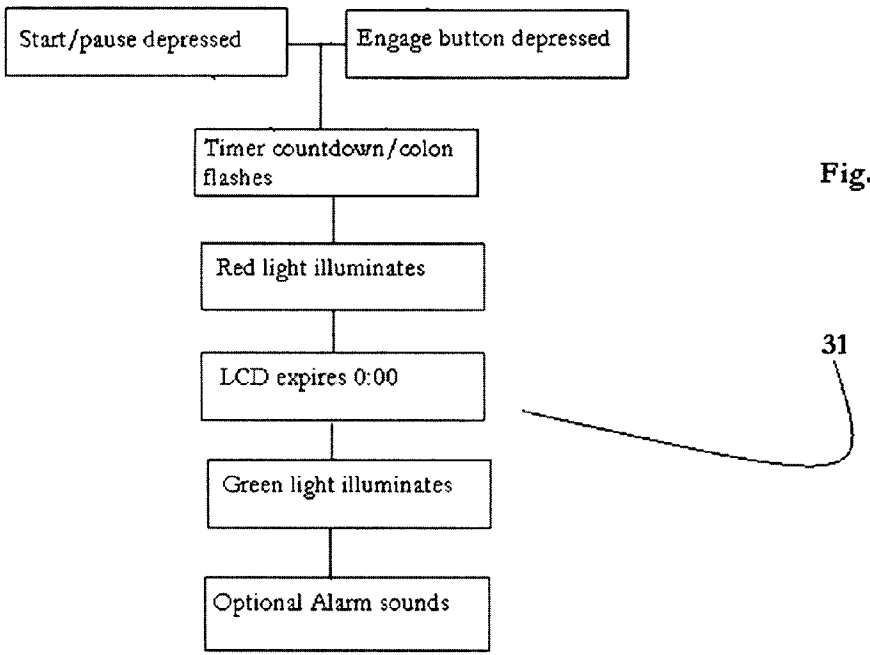

FIG. 8*a* is a flow chart illustrating the set-up steps 30 of one of the embodiments of the present invention. FIG. 8*b* is a flow chart illustrating the operational steps 31 of one of the embodiments of the present invention. Each of the set of steps is hereinbefore described.

The foregoing description of the invention along with the preferred embodiments should not be construed to limit the scope of the invention. It should be understood and obvious to one skilled in the art that the embodiments of the invention thus described may be further modified without departing from the spirit and scope of the invention as set forth in the claims that follow.

What is claimed is:

1. A timer device for inducing children to manage time, the timer comprising:

a base structure member;

a set of two lights, comprising a red light and green light on a front face of the base structure member, wherein, the red light and the green light on the front face of the base structure member are in a vertical orientation in order, from top to bottom, of red light then green light;

electronic circuitry to control timing and illumination of the red light and the green light;

a timer console on a top face of the base structure member operative to accept input to the electronic circuitry to control the illumination of the red light and green light;

a pair of engage buttons, a first engage button on a left side of the base structure member and a second engage button on a right side of the base structure member, the pair of engage buttons to accept control input to the electronic circuitry; and a power supply coupled to the red light and green light and the electronic circuitry.

2. A timer as in claim 1, wherein the electronic circuitry is selected from a group consisting of transistors and timing circuits, an integrated circuit, a system on a chip (SoC), application specific integrated circuit (ASIC) and microprocessor and memory, or combinations thereof.

3. A timer as in claim 2, wherein a processor receives instructions stored on a computer readable memory in response to input to the timer console and the pair of engage buttons;

a timer module operative to provide timing signals to the processor in response to input to the timer console; and the processor further comprising at least one controller sub-circuit and driver sub-circuit to control input commands, timer commands and drive output to the lights.

4. A timer device of claim 1, wherein the red light and green light further comprise a first white light behind a circular red lens and a second white light behind a circular green lens, respectively.

5. A timer device as in claim 1, wherein, the set of two lights, the red light and green light are light emitting diodes (LED).

6. A timer device as in claim 1, further comprising a non-illuminable yellow lens being located axially between the red light and green light.

7. A timer device as in claim 1, wherein, the timer console is comprised of a power on button, an audible alarm alert button, a liquid crystal display (LCD) digital time display panel, plus and minus hour setting buttons, plus and minus minutes setting buttons, and a start/pause button.

8. A timer device of claim 1, wherein the power supply is regulated and transformed AC power or from a DC battery.

9. A method for facilitating the management of time comprising:

pressing an engage and power button simultaneously to turn on an LCD display on a timer device;

providing a timing input value to said timer device, said timer device being coupled to a processor and memory, said processor coupled to a set of two lights, a red light and a green light; wherein said red light and said green light are positioned on a front face of a base structure member of said timer device in a vertical orientation in order, from top to bottom, of said red light then said green light;

storing said timing input value in said memory;

activating said red light with an input to said timer device to signal commencement of an activity, wherein the activating step further comprises pressing a start/pause button to illuminate the red light, whereby a colon in a liquid crystal display (LCD) flashes to indicate that time is running; and counting up or down to said timing input value and when arriving at such value, or such time has elapsed, activating the green light to signal end of time to complete an activity.

10. A method of claim 9, further comprising displaying the green light to signal end of time for completion of an activity is when the time set for the activity has been achieved or elapsed.

11. The method of claim 10 further comprising signaling, by illuminating the green light and sounding the audible alert alarm, that time has expired and hence that the activity has ended.

* * * * *